United States Patent [19]

Bergsma

[11] Patent Number: 4,609,796

[45] Date of Patent: Sep. 2, 1986

[54] LIQUID LEVEL SENSING SWITCH

[75] Inventor: Rudolph Bergsma, Ann Arbor, Mich.

[73] Assignee: Hi-Stat Michigan Manufacturing Co., Inc., Ann Arbor, Mich.

[21] Appl. No.: 732,206

[22] Filed: May 8, 1985

[51] Int. Cl.[4] ..... H01H 35/18

[52] U.S. Cl. ..... 200/84 C; 340/59; 340/624

[58] Field of Search ..... 200/84 R, 84 C, 61.2; 73/308, 313; 307/118; 340/623, 624, 59; 335/151, 153, 205

[56] References Cited

U.S. PATENT DOCUMENTS

| | | | |
|---|---|---|---|
| 3,227,839 | 1/1966 | Brown | 335/153 |
| 3,750,124 | 7/1973 | Barnes | 200/84 C |
| 4,090,050 | 5/1978 | Siiberg | 340/59 |
| 4,467,156 | 8/1984 | Dvorak | 200/84 R |

*Primary Examiner*—G. P. Tolin

*Attorney, Agent, or Firm*—Stephenson & Boller

[57] ABSTRACT

A float operated liquid level sensing switch for horizontal mounting in the sidewall of a container is disclosed. The switch can be inserted into an aperture in the sidewall regardless of its circumferential orientation with full assurance that its float is properly oriented to perform the level sensing function. The float is tubular and contains a weighting means which orients the float to a unique circumferential orientation. This positions a magnet on the float to a unique operating range. A reed switch is contained horizontally within a body portion of the switch and is surrounded by the float. The magnet is disposed to operate in a vertical plane relative to the reed switch and when the level drops to a certain level, the float similarly drops causing the magnet to activate the reed switch. In order to attain overlying relationship of the magnet to the reed switch, a pendulum weight is also included on the float diametrically opposite the magnet. The switch and electrical circuitry are isolated from the liquid whose level is being sensed.

23 Claims, 4 Drawing Figures

LIQUID LEVEL SENSING SWITCH

BACKGROUND AND SUMMARY OF THE INVENTION

This invention relates to a liquid level sensing switch, particularly a switch in which the switch axis is disposed in a generally horizontal orientation when put to use.

In certain usages of liquid level sensing switches it is desirable for the liquid level sensing switch to be mounted in a sidewall of a container for liquid whose level is to be sensed. This type of mounting may be desirable for any of a number of various reasons, a typical reason being where mounting in a vertical sense cannot be conveniently accomplished.

A horizontal mounting may involve the creation of an aperture in the sidewall of the container for liquid whose level is to be sensed and fitting of the liquid level sensing switch into the aperture. With suitable provisions, the switch can be mounted so that liquid does not leak through the aperture.

In certain instances it is desirable that the aperture be threaded and that the liquid level sensing switch have a corresponding screw thread which allows the switch to be screwed from outside the container into the aperture. Preferably a compressible seal is disposed between the switch and the aperture and compressed to seal the switch to the aperture when the switch is tightened.

Some types of liquid level sensing switches utilize a float which is buoyant in the liquid whose level is to be sensed. So long as liquid level remains above a certain minimum, the float is buoyed upwardly. As the liquid level falls below that minimum, the float assumes a more downwardly position which operates the switch.

Because a liquid level float depends for operation upon the influence of gravity, proper orientation of the float relative to vertical can be important. For a liquid level switch which is to be mounted horizontally, and particularly when it is to be threaded into a threaded aperture in the sidewall of the container, there is no assurance that the final tightened position will produce the required orientation for proper operation of the float for its liquid level sensing purpose.

Special measures can be taken to assure that the switch has been properly oriented. However these special measures might involve procedures, such as trial-and-error shimming, before a satisfactory combination of tightness, sealing, and orientation is achieved. Special measures are generally unacceptable in mass production application, such as in an automotive assembly line, because the line cannot tolerate use of trial and error procedures, or the like, if it is to be operated cost-effectively.

In one respect the present invention is directed to a new and improved liquid level sensing switch which is well-suited for usages, such as in a mass production assembly line, so that a proper orientation of the liquid level sensing float is inherently attained upon the initial installation. In other words, a liquid level sensing switch embodying principles of the invention can be installed and tightened in a threaded aperture in the sidewall of a container so that the proper tightness and leakproofness are attained while there is full assurance that the float assumes an orientation producing proper switch operation regardless of the circumferential orientation of the tightened switch. Moreover, the invention is advantageous in that it can be embodied in a package which is relatively compact, rugged, and well-suited for automotive mass production usage.

The idea of a horizontally disposed level sensing switch is not broadly new. Examples are shown by U.S. Pat. Nos. 3,750,124 and 4,467,156.

The present invention however affords significant improvements over the switches illustrated in those two patents.

The switch of U.S. Pat. No. 4,467,156 comprises an apertured cage which is disposed horizontally within the liquid whose level is to be sensed. A float-mounted contact is captured within the cage and is buoyed when immersed in liquid. When the liquid level drops below a certain minimum level, the contact and float drop so that the contact establishes electrical continuity between the cage and a separate ring which is disposed on the switch in an insulated manner from the cage. This provides a switch closure signal indicative of low level.

Such a device depends on the non-conductivity of the liquid whose level is to be sensed. Moreover, the fact that the contact is contained within the liquid may be deemed undesirable.

The switch of U.S. Pat. No. 3,750,124 comprises a reed switch which is arranged horizontally within the liquid and around which a float-operated magnet is disposed. The float comprises an elongated aperture and it is within this aperture that the reed switch is disposed. The magnet is eccentrically arranged on the float body, as viewed in cross section, and the magnet is embedded centrally within a thicker walled portion of the float.

Moreover, the float is sensitive to the circumferential orientation of the switch mounting on the sidewall of the container. The float is provided with flat outer side surfaces parallel to each other and parallel to the elongation of the aperture. These flat side surfaces confront sideguides on the switch body which guide the float for displacement in the direction of elongation of the aperture. If the sideguides and the flat side surfaces of the float are not substantially vertically disposed, the switch will not perform properly. In other words the switch is sensitive to the circumferential orientation of the switch body in its mounting on the wall of the container.

Furthermore, the switch of U.S. Pat. No. 3,750,124 has a portion of the conductive circuit immersed within liquid in the container, and hence it is susceptible to certain of the same objections as the switch of U.S. Pat. No. 4,467,156.

The present invention is directed in certain of its inventive aspects to a liquid level sensing switch which utilizes a reed switch for the switching device, but with the reed switch and electrical circuit isolated from liquid in the container. Accordingly, the electrical operation of a switch embodying principles of the present invention is unaffected by the nature of the particular liquid material whose level is being sensed.

Briefly, the present invention, in its preferred embodiment, comprises a main body structure which is provided with a screw thread which allows the switch to be threaded into a threaded aperture in the sidewall of a container for liquid whose level is to be sensed. The main body structure comprises a body portion with a circular, cylindrical sidewall bounding an interior space and an endwall which closes the interior space at the distal end. The reed switch is disposed within this interior space in a coaxial manner, and wires extend from leads at the opposite axial ends of the reed switch to an electrical connector at the opposite end of the main body structure via which the switch can be connected with an external electrical circuit. In a particular embodiment of the invention one of the wires may form a coil around the reed switch body so that when the liquid level drops below the minimum level to actuate the switch, the switch is latched in the low level indicating condition.

A float having a circular, cylindrical shape is disposed around the circular, cylindrical sidewall of the switch body portion. The float contains the magnet for operating the reed switch, and in the disclosed embodiment it contains a pendulum weight diametrically opposite the magnet which causes the magnet to vertically overlie the reed switch. Because the float is circumferentially unconstrained by the main body structure, correct orientation of the magnet in overlying relationship to the reed switch is always assured when the switch is installed regardless of the particular circumferential orientation of the main body structure.

The foregoing features, advantages and benefits of the invention, along with additional ones, will be seen in the ensuing description and claims which should be considered in conjunction with the accompanying drawing. The drawing discloses a preferred embodiment of the invention according to the best mode contemplated at the present time in carrying out the invention.

DESCRIPTION OF THE PREFERRED EMBODIMENT

Figure 1:
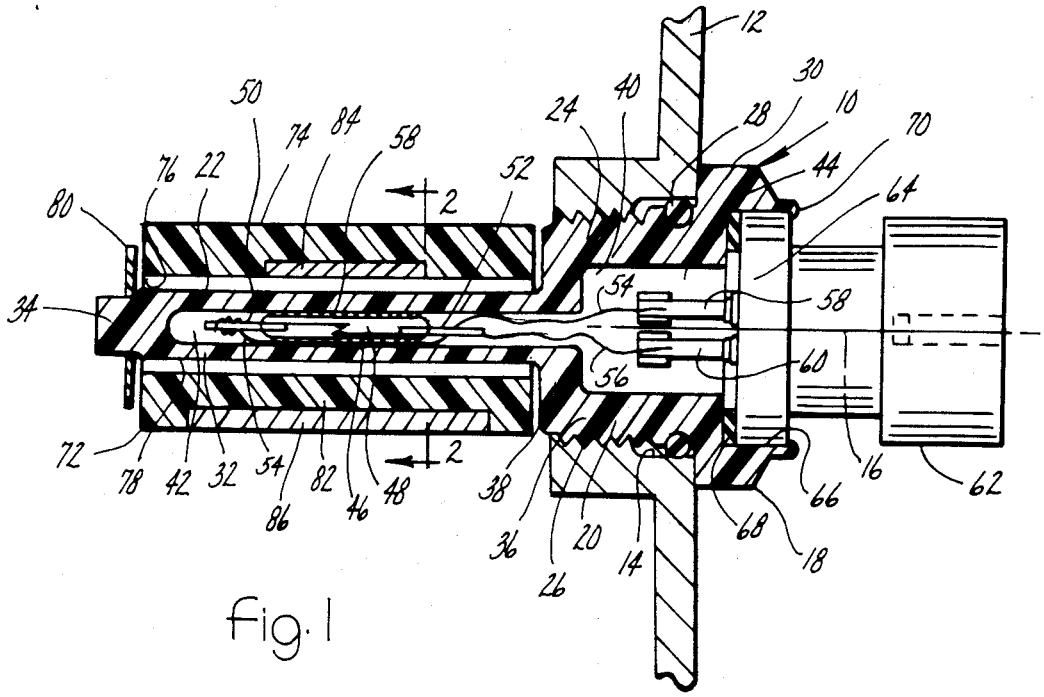
FIG. 1 is a vertical longitudinal cross sectional view through a preferred embodiment of liquid level sensing switch according to the present invention.

The drawings illustrate a presently preferred embodiment of liquid level sensing switch 10 mounted on the sidewall 12 of a liquid container. Sidewall 12 is shown to be vertical and to contain a circular aperture 14 within which switch 10 is disposed.

Switch 10 comprises a main longitudinal axis 16 which is coaxial with aperture 14 to assume a horizontal orientation when the switch is fitted in aperture 14.

Switch 10 comprises a main body 18 which forms a closure for aperture 14 when the switch is installed. Body 18 comprises a larger diameter body portion 20 and a smaller diameter body portion 22.

Aperture 14 is provided with a screw thread 24, and the OD of body portion 20 comprises a complementary screw thread 26 so that the switch can be screwed coaxially into aperture 14 by screwing thread 26 into thread 24. A circular O-ring seal 28 is disposed in a circular groove extending around the outside of body portion 20 axially outwardly of screw thread 26 and is compressed to form a seal between main body 20 and the wall of aperture 14 when switch 10 is tightened in aperture 14.

Since substantial tightening is important in many usages of the present invention, body portion 20 is provided with a polygonal surface 30 (a hex for example) which is concentric with axis 16 and can be engaged by a suitable tool (not shown) for screwing the switch into the aperture and tightening it.

When the switch is in the installed position as shown, the smaller diameter body portion 22 is disposed within the interior of the container. Body portion 22 comprises a circular, cylindrical sidewall 32 extending from body portion 20. An endwall 34 is at the distal end of sidewall 32 opposite body portion 20.

Body portion 20 comprises its own circular, cylindrical sidewall 36 and the two body portions 20 and 22 join by means of a shoulder 38.

Body 18 comprises an interior space 40 which extends through body portion 20, and through body portion 22 as far as endwall 34. This space has a circular, cylindrical shape coaxial with axis 16 and comprises a smaller diameter portion 42 extending from endwall 34 through body portion 2Z and shoulder 38 where it enlarges into a larger diameter portion 44.

A reed switch 46 is disposed within the smaller diameter portion 42 and is approximately centered along the length of the smaller diameter body portion 22. Reed switch 46 is of conventional construction comprising a body 48 (typically a glass capsule) which forms an enclosure for the reed. Leads 50 and 52 project from opposite axial ends of body 48, and each lead is associated with a corresponding reed.

Switch 10 comprises means for connecting reed switch 46 with an external electrical circuit (not shown), and such means comprises a pair of wires 54 and 56 respectively. One end of wire 54 attaches to lead 50, and one end of wire 56 attaches to lead 52. Wire 54 comprises a number of turns 58 snugly wrapped around the outside of body 48. These may be wrapped in a helical layer, and in a suitable number of turns, to perform a latching function as will subsequently be explained in greater detail. The helical wrapping of the several turns of wire 54 around the reed switch body also serves to center the reed switch with respect to axis 16 and can assist in mounting the reed switch within the smaller diameter interior space portion 42.

The respective wires 54 and 56 attach at their opposite ends to respective terminals 58 and 60 which are mounted on a terminal connector housing 62. Terminal connector housing 62 comprises a circular mounting flange 64 which fits within a counterbore 66 at the outer axial end of body 20 coaxial with axis 16. Preferably an annular seal 68 is disposed between flange 64 and body 20 and the housing is crimped at 70 against flange 64 whereby terminal connector housing 62 is securely retained in counterbore 66 on body 20 with seal 68 providing a seal between the two. A mating plug (not shown) is intended to engage with terminal connector housing 62 and make contact with the terminals 58 and 60 so as to connect the switch assembly with an external circuit.

For example, the external circuit may comprise a battery and a lamp connected in series. Reed switch 46 has its reeds normally open so that there is no circuit continuity between terminals 50 and 52. In such a condition with the switch connected with the external circuit just described, the lamp does not light. This is the condition which exists when there is a satisfactory level of liquid in the container.

However when the liquid level drops below a certain minimum level to which the switch is sensitive, the reed switch 46 closes to cause the lamp to light and thereby provide a warning signal that the liquid has fallen to that certain level. The provision of the several turns of wire surrounding the reed switch serves to hold the reeds closed because of the magnetic force which is created when current flows through the circuit. In this way once the reed switch has been closed, it remains so until the electric power is cut off, even if the level should rise above the minimum. While this self-latching aspect is deemed desirable for certain uses, it is an ancillary aspect of the invention, and self-latching can be eliminated by simply not wrapping the reed switch with the helical turns of wire.

Exactly how the reed switch senses liquid level will now be explained.

Liquid level sensing switch 10 further includes a float 72 which is disposed on body portion 22. Float 72 has a tubular shape which is preferably substantially a circular, cylindrical one. It has a substantially circular outside diameter 74 and a substantially circular inside diameter 76. The inside diameter 76 is somewhat larger than the outside diameter 78 of body portion 22 which is also preferably circular.

Figure 2:
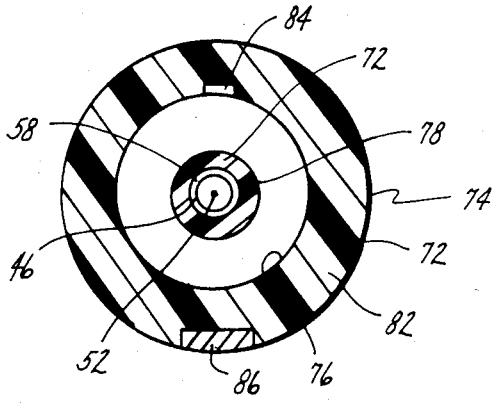
FIG. 2 is a transverse cross sectional view taken in the direction of arrows 2—2 in FIG. 1, and enlarged.

FIGS. 1 and 2 illustrate float 72 in a coaxial position with respect to body portion 22, and it can be seen that there is a noticeable circular annular space between the two which affords the float a range of eccentricity along any radial relative to body portion 22.

The outside diameter 74 of float 72 is just slightly less than the diameter of thread 24 as measured across the thread's crest. This allows float 72 to pass through aperture 14 when the switch is being inserted from right to left in aperture 14 as viewed in FIG. 1.

The length of float 72 is less than that of body portion 22. A circular annular keeper 80 is pressed, or otherwise secured, onto endwall 34. Keeper 80 and shoulder 38 of larger diameter body portion 20 serve to axially capture float 72 on body portion 22, but with a slight amount of axial play possible for the float.

Float 72 comprises a float body 82 of a material which is buoyant in the liquid whose level is to be sensed. The body of the float provides it with its generally tubular shape. A weighting means, which in the preferred embodiment comprises a magnet 84 and a pendulum weight 86, is disposed on float body 82 but without rendering the float non-buoyant. Rather the weighting means endows the float with a characterictic whereby magnet 84 assumes a particular circumferential orientation as viewed along axis 16, regardless of the particular circumferential orientation of main body 18.

In the illustrated embodiment which comprises both magnet 84 and pendulum weight 86 for the weighting means, the particular circumferential orientation comprises magnet 84 being disposed vertically over the reed switch, essentially at the twelve o'clock position as viewed axially. This position is attained by making pendulum weight 86 exert a larger moment about the axis of the float than magnet 84. Hence the pendulum weight will assume the six o'clock position, and by locating the magnet diametrically opposite the pendulum weight, the magnet is forced to assume the twelve o'clock position.

While in general when using a pendulum weight 86 it will be desirable to make the mass of the pendulum weight somewhat greater than the mass of the magnet, it is advantageous to place the pendulum at the OD of the float and the magnet 84 at the ID to aid in maximizing the moment differential.

It will be observed that magnet 84 and pendulum weight 86 are arranged generally centrally along the length of the float so that there is negligible, if any, lengthwise imbalance in the float. In general it will be desirable to avoid any significant lengthwise imbalance.

The weighting means is effective to assure unique circumferential orientation of the float, both when the float is sensing liquid as well as when it is not, such as when the switch is first assembled into aperture 14 before the container is filled with liquid. If for any reason the float is oriented with the pendulum weight in other than the six o'clock position, such a position will be unstable because the mcment exerted by the pendulum weight will cause the float to turn to a position where the pendulum weight is at six o'clock.

Figure 4:
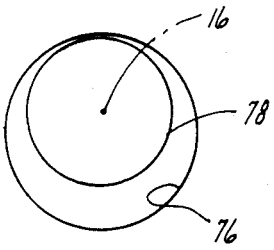
FIG. 4 is a view like FIG. 3 but illustrating a different position.

After installation of the switch on the container with the container empty, the float is supported on body portion 22 along a line of contact which will generally be at the twelve o'clock position. If the pendulum wright were at other than the six o'clock position, the float would turn until the pendulum weight was at the six o'clock position. Such a position is shown by FIG. 4.

During the process of installing switch 10 on sidewall 12, body portion 22 will rotate as the switch body is threaded into aperture 14. The final circumferential orientation of the body can depend upon a number of factors. With the invention, the float will automatically assume the proper operating position because of the effect of the weighting means.

The switch is disposed on the container at a particular level where the sensing of level of liquid is to occur. If the liquid level falls below this level, switch 10 will so indicate. So long as the liquid level remains above the sensing level, the float will be buoyed upwardly, such as to the position depicted by FIG. 3, and the switch reeds are open.

As the liquid level drops and approaches the sensing level, the float begins to move progressively downwardly relative to body portion 22, and magnet 84 increasingly approaches reed switch 46. At some point in the downward travel of the float, the force of magnet 84 acting on reed switch 46 is effective to close the reeds. This causes the warning signal to be given in the manner described above.

Figure 3:
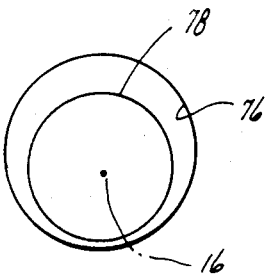
FIG. 3 is a schematic view similar to FIG. 2 showing one operative position.

Because of manufacturing tolerance considerations, the nominal level at which the reeds should close, is preferably established exactly midway between the two extremes of travel represented by FIGS. 3 and 4. However this may vary somewhat depending upon particular design. In this way it will be assured that when the float is in the position of FIG. 3 the reeds will be open, and when the float is in the position of FIG. 4, they will be closed. In other words, an adverse accumulation of tolerances in a switch assembly will nonetheless fail to affect switch operation although there may be some slight variation in the precise level at which the signal is given. For purposes of the expected usage of the switch this is entirely acceptable.

The illustrated embodiment is well-suited to cause a warning signal to be given when the level drops below the sensing level. As such, closure of the reeds is used to indicate a low level condition.

For various other reasons it may be deemed desirable to utilize a construction where the reeds are caused to open when the level drops below the sensing level. A switch embodying principles of the invention may provide this capability by causing the magnet to be disposed at the six o'clock position. The magnet itself may be sufficient to form the pendulum weight by itself such that no additional pendulum weight is required. However, where such an additional pendulum weight is used with the magnet at the six o'clock position, the pendulum weight is also at the six o'clock position.

A liquid level sensing switch according to the present invention has a number of important advantages. For one the switch can be installed in an aperture without concern for its particular circumferential orientation. This means that a switch, such as in the preferred embodiment, can be threaded into the aperture and tightened with full assurance that the float will assume the proper orientation. This makes the switch especially advantageous for mass production assembly line installations such as in the automotive industry.

Another important advantage of the invention is that the current carrying portions of the switch are completely isolated from the liquid whose level is being sensed. Still another advantage is the relative compactness and ruggedness which may be embodied in the switch. It is also adapted to itself be pass-produced in a cost-effective manner.

A representative usage of the switch is in association with a radiator to sense level of coolant in the radiator. Prior switches such as those in the two patents mentioned above would not be suitable for this use because of conductivity of the coolant medium. Other usages of the invention are fully contemplated within the scope of the present invention.

In the illustrated construction the main body portion of the switch is a non-magnetic material so as to allow the magnet 84 to be effective on the reed switch without impediment. While certain non-magnetic materials may be suitable for the integral formation of the screw thread with the main body portion, other embodiments may comprise a two-piece construction for the main body portion wherein portion 22 is a non-magnetic material and the portion 20 containing the screw thread is another material, metallic for example.

The illustrated terminal housing and terminal arrangement is also merely exemplary and different forms may be used.

It is possible that the reed switch could be embodied as a grounding switch and this could involve for example a two-piece body construction as just described. In such a construction one of the leads of the reed switch would be connected to a metallic body portion 20 so as to become grounded when that portion is screwed into the aperture. The other lead would be connected by a wire to a single terminal for making connection to the electric circuit with which the switch is used.

The switch of the present invention therefore possesses significant advantages over prior switches. While a preferred embodiment of the invention has been disclosed, it will be appreciated that principles are applicable to other embodiments.

What is claimed is:

1. A liquid level sensing switch which fits into a threaded aperture in a sidewall of a liquid container for providing a signal related to level of liquid in the container, said sensing switch comprising a main body structure which has a main axis and a coaxial screw thread via which said sensing switch coaxially screws into the threaded aperture of the container to result in the main axis of the main body structure being disposed in a substantially horizontal orientation when the sensing switch is fitted into the threaded aperture of the container, said main body structure forming a closure for the threaded aperture so that liquid in the container will not leak out through the aperture when the sensing switch has been fitted into the aperture, said main body structure further comprising an axially extending body portion which is disposed within the container when the sensing switch has been fitted into the aperture and a reed switch on said body portion disposed generally parallel therewith, means for connecting said reed switch to an external electrical circuit, said body portion comprising means defining a circular, cylindrical ofter surface which extends parallel with said main axis, a buoyant float which has its own main axis and is disposed on said body portion generally parallel with the main axis of said main body structure, said float comprising a float body of a material which is buoyant in the liquid whose level is to be sensed, said float comprising means defining a circular, cylindrical inner surface which extends around and is of a larger diameter than said circular, cylindrical outer surface defined on said body portion, said float and said main body structure being constructed and arranged such that said float is free to assume its own circumferential orientation independently of the circumferential orientation of said body portion, and means disposed on said float body to constrain the float to a single stable circumferential orientation on said body portion irrespective of the circumferential orientation of said body portion, said last-mentioned means comprising weighting means comprising a magnet disposed on said float body without rendering the float non-buoyant in the liquid whose level is to be sensed such that the force of gravity acting on the float creates a unique circumferential orientation of the float irrespective of the circumferential orientation of said body portion whereby the magnet is disposed for operation within a predetermined range of positions in accordance with liquid level to act upon said reed switch in a predetermined manner correlated with liquid level.

2. A liquid level sensing switch as set forth in claim 1 in which said body portion comprises an interior space disposed interiorly of the circular, cylindrical outer surface defined thereon, and said reed switch is disposed within said interior space such that said reed switch and said float at least partially axially overlap.

3. A liquid level sensing switch as set forth in claim 2 in which said reed switch and the circular cylindrical outer surface defined on said body portion are coaxially arranged with respect to said main axis.

4. A liquid level sensing switch as set forth in claim 1 in which said reed switch comprises an axially extending body having leads exiting said body at opposite axial ends thereof, said means for connecting said reed switch in an external electrical circuit comprises respective wires connected to the respective leads of the reed switch, one of said wires forming a coil disposed around the outside of the reed switch body for rendering the reed switch self-latching when a particular level condition is sensed.

5. A liquid level sensing switch as set forth in claim 1 in which said body portion comprises a cylindrical sidewall bounding a cylindrical interior space and an endwall closing one end of the interior space, said cylindrical sidewall and said endwall forming at least a portion ofthe closure for the threaded aperture when the switch is fitted into the aperture, said reed switch being disposed within said interior space.

6. A liquid level sensing switch as set forth in claim 5 in which said body portion extends axially from a further body portion of larger diameter, said further body portion containing the screw thread via which the sensing switch coaxially screws into the threaded aperture, said float being disposed on said first-mentioned body portion within said interior space such that it and said reed switch at least partially axially overlap.

7. A liquid level sensing switch as set forth in claim 6 including means including said further body portion for axially capturing said float on said first-mentioned body portion and in which said float has an outer diameter which is substantially identical to the diameter of said further body portion.

8. A liquid level sensing switch as set forth in claim 1 in which said means for connecting said reed switch in an external electrical circuit includes a lead wire formed into a coil around the reed switch to render the reed switch self-latching when a particular level condition is sensed.

9. A liquid level sensing switch as set forth in claim 1 in which said main body structure comprises a further portion containing the screw thread via which said sensing switch coaxially screws into the threaded aperture of the container, said further body portion having a larger diameter than that of said first-mentioned body portion, and means including said further body portion for axially capturing said float on said first-mentioned body portion.

10. A liquid level sensing switch as set forth in claim 9 in which said float has a circular, cylindrical shape whose outside diameter is substantially equal to the diameter of said further body portion.

11. A liquid level sensing switch as set forth in claim 10 in which said magnet is disposed on said float at the circular, cylindrical inner surface defined thereon.

12. A liquid level sensing switch as set forth in claim 11 in which said weighting means includes a pendulum weight disposed on the float diametrically opposite the magnet and at a radially more outward location than the magnet.

13. A liquid level sensing switch as set forth in claim 1 in which said float comprises a circular, cylindrical shape including an outer cylindrical surface which allows the float to pass through the threaded aperture, said magnet being disposed on said float at the circular, cylindrical inner surface defined thereon.

14. A liquid level sensing switch as set forth in claim 13 in which said weighting means further includes a pendulum weight disposed on the float diametrically opposite the magnet and at the outside diameter of the float.

15. A liquid level sensing switch as set forth in claim 1 in which said weighting means includes a pendulum weight on the float arranged diametrically opposite the location of the magnet on the float.

16. A liquid level sensing switch as set forth in claim 1 in which said float has a circular, cylindrical outside diameter less than that of the threaded aperture so as to allow the float to pass through the aperture and in which said magnet is disposed on the float at the inside diameter therof.

17. A liquid level sensing switch as set forth in claim 16 in which said weighting means comprises a pendulum weight disposed on the float at the outside diameter thereof.

18. A liquid level sensing switch as set forth in claim 17 in which the pendulum weight is disposed on the float diametrically opposite the location of the magnet.

19. A liquid level sensing switch which fits into an aperture in a sidewall of a liquid container for providing a signal related to level of liquid in the container, said sensing switch comprising a main body structure which has a main axis and fits into the aperture of the container so that the main axis is disposed in a substantially horizontal orientation, said main body structure forming a closure for said aperture so that liquid will not leak out through the aperture when the main body structure has been fitted into the aprture, said main body structure comprising an axially extending body portion which is disposed within the container when the main body structure is fitted into the aperture, said body portion comprising a cylindrical sidewall forming a cylindrical interior space and an endwall closing one end of the interior space, said cylindrical sidewall and said endwall forming at least a portion of the closure for the aperture, a reed switch disposed within said interior space, means for connecting the reed switch to an external electrical circuit, a buoyant cylindrical float disposed on said body portion and comprising means defining a circular, cylindrical internal surface which extends around said body portion, a magnet on said float for operating the reed switch, said float and said main body structure being constructed and arranged such that the effect of gravity acting on the float is effective to position the float to a unique circumferential orientation which defines a predetermined range of operating positions for the magnet in accordance with liquid level so that the magnet can act upon the reed switch in a predetermined manner correlated with the liquid level.

20. A liquid level sensing switch as set forth in claim 19 in which said main body structure comprises a further portion of larger diameter than said first-mentioned body portion, and means including said further body portion to axially capture the float on said first-mentioned body portion.

21. A liquid level sensing switch as set forth in claim 19 in which said float comprises a float body formed of a material which is buoyant in the liquid whose level is to be sensed, said magnet being disposed on said float body ina particular circumferential orientation and further including a pendulum weight on said float body diametrically opposite the location of the magnet.

22. A liquid level sensing switch which fits into an aperture in a sidewall of a liquid container for providing a signal related to level of liquid in the container, said sensing switch comprising a main body structure which has a main axis and fits into the aperture so that that main axis is disposed in a substantially horizontal orientation, said main body structure forming a closure for said aperture so that liquid will not leak out through the aperture when said main body structure has been fitted into the aperture, said main body structure comprising an axially extending body portion which is disposed within the container when said main body structure has been fitted into the aperture, a reed switch on said main body portion which has its axis generally parallel therewith, means for connecting the reed switch to an external electrical circuit, a float comprising a magnet for operating said reed switch, said float comprising a float body of a material which is buoyant in the liquid whose level is to be sensed, said float body being of a cylindrical shape fitting onto said body portion, said main body structure and said float being constructed and arranged such that the float is circumferentially unconstrained by said main body structure so as to allow the float to move freely around said main body portion, said float body comprising a float constructed of a material which is buoyant in the liquid whose level is to be sensed, and means disposed on said float body to constrain the float to a single stable circumferential orientation on said body portion, said last-named means comprising a pendulum weight disposed on said float body diametrically opposite the location of said magnet without rendering the float non-buoyant in the liquid whose level is to be sensed so as to create a unique circumferential orientation of the magnet so that the magnet operates within a predetermined range of positions in accordance with liquid level to act upon said reed switch in a predetermined manner correlated with liquid level.

23. A liquid level sensing switch as set forth in claim 22 in which the magnet is disposed on the float body at the inside diameter thereof and the pendulum weight is disposed on the float body at the outside diameter thereof.

* * * * *

UNITED STATES PATENT AND TRADEMARK OFFICE

CERTIFICATE OF CORRECTION

PATENT NO. : 4,609,796

DATED : September 2, 1986

INVENTOR(S) : Rudolph Bergsma

It is certified that error appears in the above-identified patent and that said Letters Patent are hereby corrected as shown below:

Column 4, line 15, "2Z" should read --22--;

Column 6, line 15, "wright" should read --weight--;

Column 7, line 16, "pass-produced" should read --mass-produced--;

Column 8, line 6, "ofter" should read --outer--;

Column 8, line 60, "ofthe' should read --of the--;

Column 10, line 44, "that" (second occurrence) should read --the--;

Column 10, lines 63 through 65, the phrase "said float body comprising a float constructed of a material which is buoyant in the liquid whose level is to be sensed," should deleted.

Signed and Sealed this

Twenty-third Day of December, 1986

*Attest:*

DONALD J. QUIGG

*Attesting Officer* *Commissioner of Patents and Trademarks*